US007907102B2

(12) United States Patent
Yoon

(10) Patent No.: US 7,907,102 B2
(45) Date of Patent: Mar. 15, 2011

(54) PLASMA DISPLAY APPARATUS AND METHOD OF DRIVING THE SAME

(75) Inventor: Sangjin Yoon, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 903 days.

(21) Appl. No.: 11/781,434

(22) Filed: Jul. 23, 2007

(65) Prior Publication Data

US 2008/0018627 A1 Jan. 24, 2008

(30) Foreign Application Priority Data

Jul. 21, 2006 (KR) ..... 10-2006-0068774

(51) Int. Cl.
*G09G 3/28* (2006.01)

(52) U.S. Cl. ..... 345/60; 345/204; 315/169.4

(58) Field of Classification Search ..... 345/60, 345/67, 204; 313/581; 348/797; 315/169.1, 315/169.4

See application file for complete search history.

(56) References Cited

U.S. PATENT DOCUMENTS

| | | | | |
|---|---|---|---|---|
| 5,724,053 | A | 3/1998 | Nagakubo | 345/60 |
| 7,733,305 | B2 * | 6/2010 | Nishimura et al. | 345/67 |
| 7,764,249 | B2 * | 7/2010 | Kim et al. | 345/60 |
| 2005/0073616 | A1 | 4/2005 | Joo et al. | 348/797 |

FOREIGN PATENT DOCUMENTS

| | | | |
|---|---|---|---|
| EP | 1 791 107 | A2 | 5/2007 |
| KR | 10-2003-0045214 | A | 6/2003 |
| KR | 10-2004-0068419 | A | 7/2004 |

OTHER PUBLICATIONS

European Search Report dated Jul. 31, 2008.

* cited by examiner

*Primary Examiner* — Abbas I Abudlselam
(74) *Attorney, Agent, or Firm* — KED & Associates, LLP

(57) ABSTRACT

A plasma display apparatus is disclosed. The plasma display apparatus includes a plasma display panel for displaying an image by a frame comprising a plurality of subfields, and a driver for, when a vertical frequency of an image signal inputted is less than a critical frequency, dividing the frame into a first subfield group and a second subfield group each comprising one or more subfields, the number of subfields of the first subfield group being different from the number of subfields of the second subfield group, and when the vertical frequency is more than the critical frequency, constituting the frame by a third subfield group comprising one or more subfields.

15 Claims, 13 Drawing Sheets

(a)

(b)

PLASMA DISPLAY APPARATUS AND METHOD OF DRIVING THE SAME

This application claims the benefit of Korean Patent Application No. 10-2006-0068774 filed in Korea on Jul. 21, 2006, which is incorporated herein by reference for all purposes as if fully set forth herein.

BACKGROUND

1. Field

This document relates to a plasma display apparatus and a method of driving the plasma display apparatus.

2. Description of the Related Art

Plasma display apparatus comprises a plasma display panel having an electrode and a driver for applying a driving signal to the electrode of the plasma display panel.

In general, the plasma display panel comprises a phosphor layer and a plurality of electrodes in a discharge cell partitioned by a barrier wall.

The driver applies a driving signal to the discharge cell via the electrode.

Thus, the driving signal supplied induces a discharge within the discharge cell. If the discharge is induced by the driving signal within the discharge cell, a discharge gas filled in the discharge cell generates vacuum ultraviolet rays. The vacuum ultraviolet rays excite phosphors formed in the discharge cell and generate visible rays. By the visible rays, an image is displayed on a screen of the plasma display panel.

A conventional plasma display apparatus was used as a television device, supporting only National Television System Committee (NTSC) and Phase Alternate Line (PAL).

SUMMARY

An aspect of this document is to provide a plasma display apparatus and method of driving the same not only functioning as a television device that receives a data signal from a broadcasting station and displays the data signal, but also functioning as a device for effectively displaying even a data signal inputted through a variety of input units, for example, wired/wireless communication units such as cable, infrared communication units, etc.

Another aspect of this document is to provide a plasma display apparatus and method of driving the same for altering a structure of a frame depending on a vertical frequency of an image signal inputted.

In an aspect, a plasma display apparatus comprises a plasma display panel for displaying an image by a frame comprising a plurality of subfields, and a driver for, when a vertical frequency of an image signal inputted is less than a critical frequency, dividing the frame into a first subfield group and a second subfield group each comprising one or more subfields, the number of subfields of the first subfield group being different from the number of subfields of the second subfield group, and when the vertical frequency is more than the critical frequency, constituting the frame by a third subfield group comprising one or more subfields.

In another aspect, a plasma display apparatus comprises a plasma display panel for displaying an image by a frame comprising a plurality of subfields, and a driver for, when a vertical frequency of an image signal inputted is less than a critical frequency, dividing the frame into a first subfield group and a second subfield group each comprising one or more subfields and varying a starting point where the second subfield group is arranged depending on the vertical frequency of the image signal.

In still another aspect, a method for driving a plasma display apparatus displaying an image during a frame comprising a plurality of subfields, wherein the driving is performed at a first frequency band and a second frequency band divided on the basis of a specific vertical frequency of an image signal inputted, and wherein the driving is performed at the first frequency band and the second frequency band each comprising at least two frequencies at which an image is displayed by a frame having a different length.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention. In the drawings.

DETAILED DESCRIPTION OF EMBODIMENTS

Hereinafter, an implementation of this document will be described in detail with reference to the attached drawings.

Figure 1:
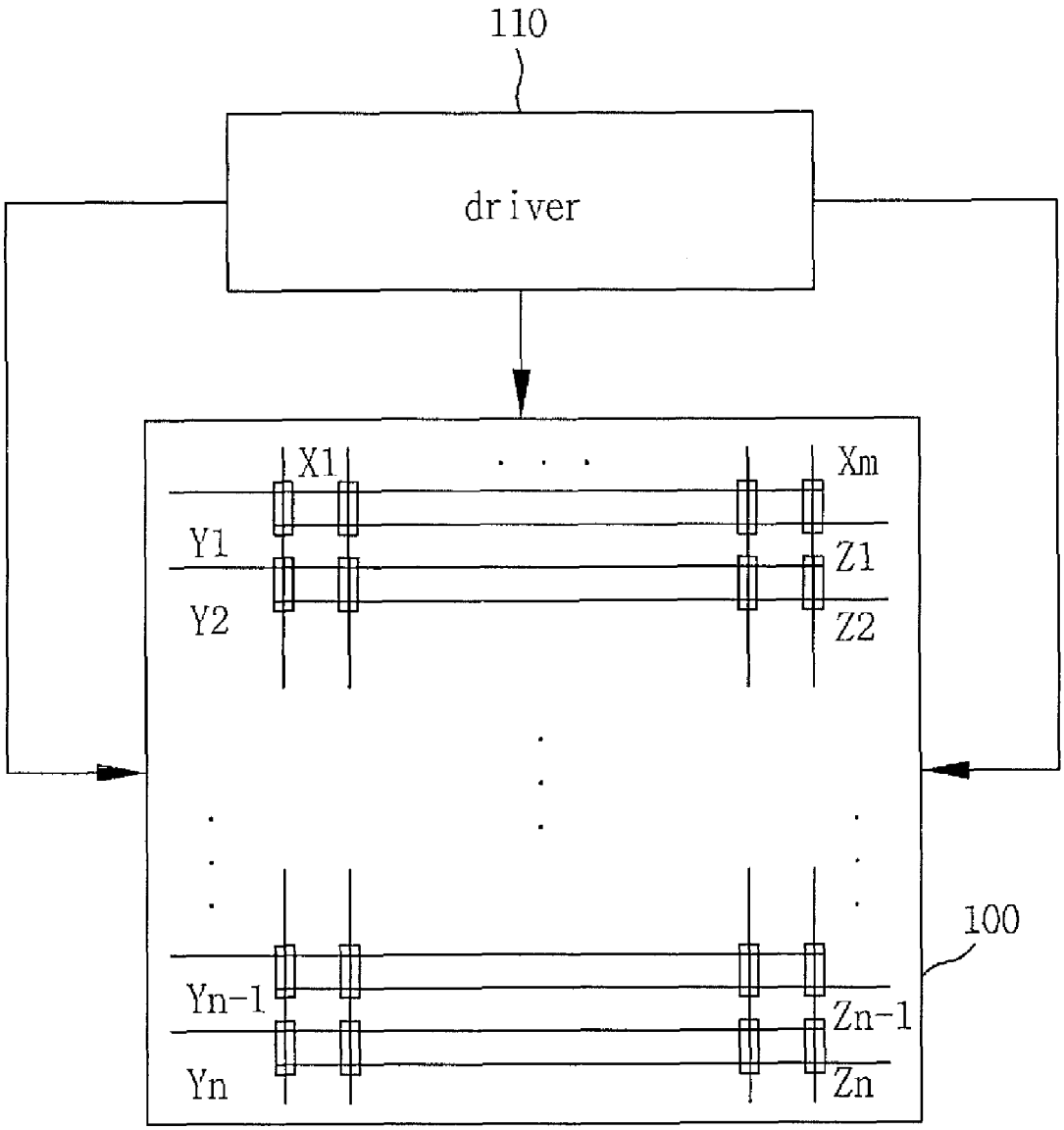
FIG. 1 illustrates a configuration of a plasma display apparatus according to the present invention.

FIG. 1 illustrates a configuration of a plasma display apparatus according to the present invention. Referring to FIG. 1, the inventive plasma display apparatus includes a plasma display panel 100 and a driver 110.

Regarding the driver 110, when a vertical frequency of an image signal inputted is less than a critical frequency, a frame is divided into a first subfield group and a second subfield group each comprising one or more subfields. When the vertical frequency is greater than the critical frequency, a frame is comprised of a single third subfield group comprising one or more subfields. The critical frequency is set within a range of about 50 Hz to 70 Hz. The number of subfields belonging to the first subfield group can be different or equal to the number of subfields belonging to the second subfield group.

FIG. 1 illustrates only a case that the driver 110 is of a single board form. However, in the present invention, the driver 110 can be also of a plural board form depending on an electrode formed in the plasma display panel 100.

For example, in case where a scan electrode and a sustain electrode are formed in parallel with each other and an address electrode is formed to intersect with the scan electrode and the sustain electrode, the driver 110 can be comprised of a first driver (not shown) for driving the scan electrode, a second driver (not shown) for driving the sustain electrode, and the third driver (not shown) for driving the address electrode. Meantime, the plasma display apparatus comprises a controller (not shown in FIG. 1) for receiving an image signal from the external and outputting a driving control signal of an address electrode, a driving control signal of a scan electrode, and a driving control signal of a sustain electrode.

Figure 2A:
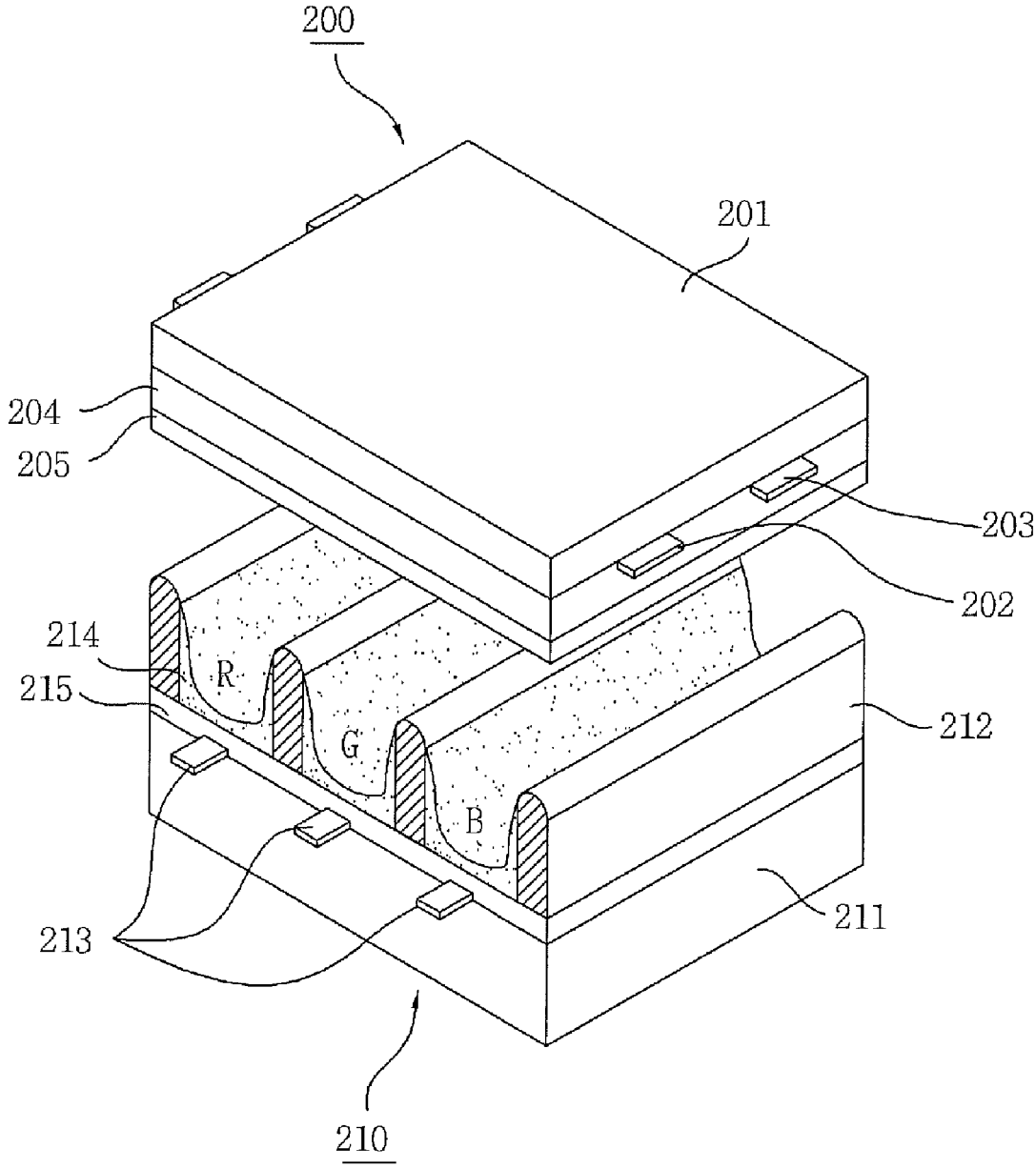
FIGS. 2A and 2B illustrate an example of a structure of a plasma display panel comprised in a plasma display apparatus according to the present invention.
Figure 2B:
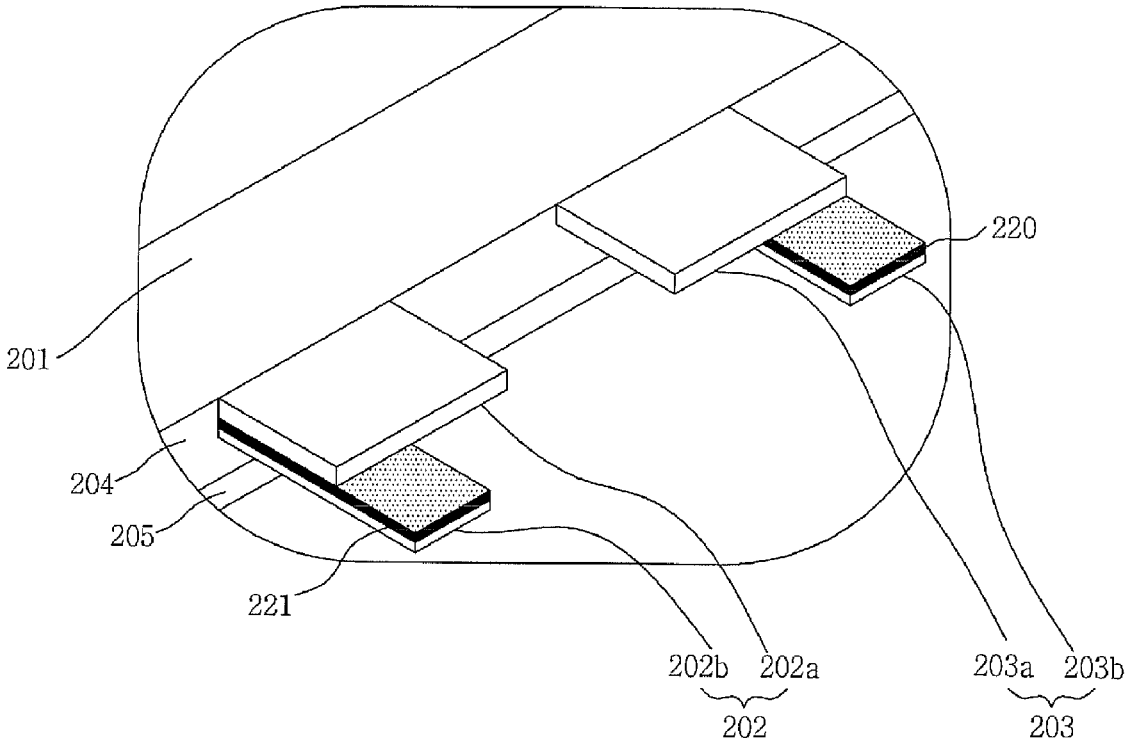

FIGS. 2A and 2B illustrate an example of a structure of a plasma display panel comprised in a plasma display apparatus according to the present invention.

Referring to FIG. 2A, the inventive plasma display panel can be formed by sealing a front panel 200 and a rear panel 210. The front panel 200 comprises a front substrate 201 in which a scan electrode 202 and a sustain electrode 203 are formed in parallel with each other. The rear panel 210 comprises a rear substrate 211 in which an address electrode 213 is formed to intersect with the scan electrode 202 and the sustain electrode 203.

The scan electrode 202 and the sustain electrode 203 formed over the front substrate 201 can induce and maintain a discharge within a discharge cell.

An upper dielectric layer 204 can be formed on the front substrate 201 comprising the scan electrode 202 and the sustain electrode 203 to cover the scan electrode 202 and the sustain electrode 203.

The upper dielectric layer 204 can limit a discharge current of the scan electrode 202 and the sustain electrode 203 and insulate between the scan electrode 202 and the sustain electrode 203.

A protection layer 205 can be formed on an upper surface of the upper dielectric layer 204 in such a manner that oxide magnesium (MgO) is deposited on the upper dielectric layer 204.

The address electrode 213 formed on the rear substrate 211 is an electrode for applying a data signal to a discharge cell.

A lower dielectric layer 215 can be formed on the rear substrate 211 comprising the address electrode 213 to cover the address electrode 213.

A barrier wall 212 of a stripe type, a well type, a delta type, a honeycomb type, etc. is formed on the lower dielectric layer 215 to partition a discharge space, that is, a discharge cell. Thus, red (R), green (G), and blue (B) discharge cells can be formed between the front substrate 201 and the rear substrate 211.

A discharge gas is filled in the discharge cell partitioned by the barrier wall 212. A phosphor layer 214 is formed between two adjacent barrier walls 212 to emit visible rays.

FIG. 2A illustrates only a case that the scan electrode 202 and the sustain electrode 203 each are comprised of a single layer. Unlike this, one or both of the scan electrode 202 and the sustain electrode 203 can be comprised of plural layers.

Referring to FIG. 2B, the scan electrode 202 and the sustain electrode 203 each can be comprised of two layers that are a laminate of bus electrodes 202*b* and 203*b* formed of argentums (Ag) and transparent electrodes 202*a* and 203*a* formed of transparent Indium Tin Oxide (ITO).

It is desirable that when the scan electrode 202 and the sustain electrode 203 comprise the bus electrodes 202*b* and 203*b*, black layers 220 and 221 are further provided between the transparent electrodes 202*a* and 203*a* and the bus electrodes 202*b* and 203*b* to prevent the bus electrodes 202*b* and 203*b* from reflecting external light.

In FIG. 2B, the scan electrode 202 and the sustain electrode 203 can be comprised of only the bus electrodes 202*b* and 203*b* excepting the transparent electrodes 202*a* and 203*a*. In detail, the scan electrode 202 and the sustain electrode 203 can be comprised of the bus electrodes 202*b* and 203*b* comprised of a single layer.

Figure 3:
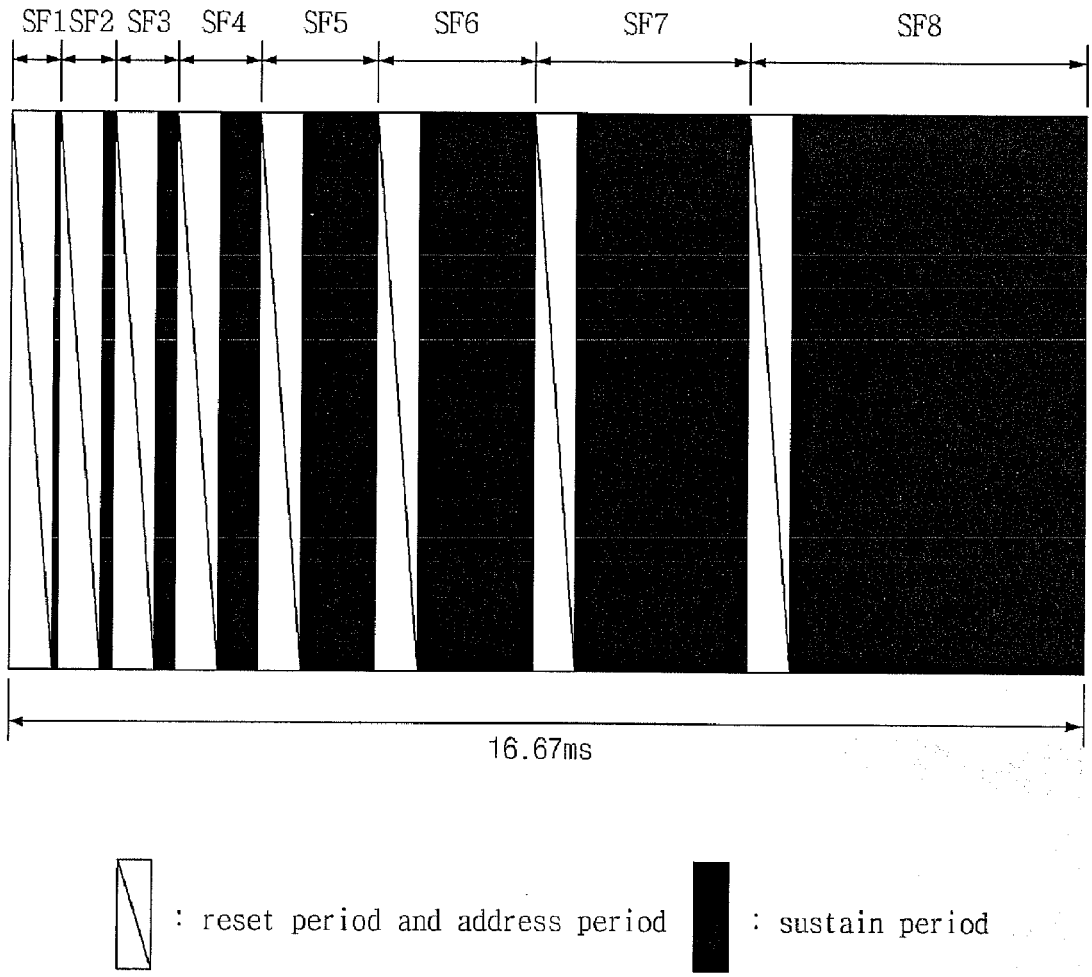
FIG. 3 illustrates an example of a frame for realizing a gray level of an image on a screen of a plasma display panel according to the present invention.

FIG. 3 illustrates an example of a frame for realizing a gray level of an image on a screen of a plasma display panel according to the present invention.

Referring to FIG. 3, the frame is divided into a plurality of subfields each having the different number of times of light emission.

Also, though not shown, each subfield can be divided into a reset period for initializing all discharge cells, an address period for selecting a discharge cell for discharge, and a sustain period for realizing a gray level depending on the number of times of discharge.

For example, as shown in FIG. 3, when an image is displayed with 256 gray levels, a frame period of 16.67 milliseconds (ms) corresponding to 1/60 seconds is divided into eight subfields (SF1 to SF8). The eight subfields (SF1 to SF8) each are again divided into a reset period, an address period, and a sustain period.

A gray level weight of a subfield can be set by controlling the number of sustain signals applied during a sustain period. A gray level of a variety of image signals is realized by controlling the number of sustain signals applied during a sustain period of each subfield depending on a gray level weight of each subfield.

FIG. 3 illustrates only a case that one frame is comprised of eight subfields. Unlike this, the number of subfields constituting one frame can variously change to ten, eleven, twelve, etc.

Figure 4:
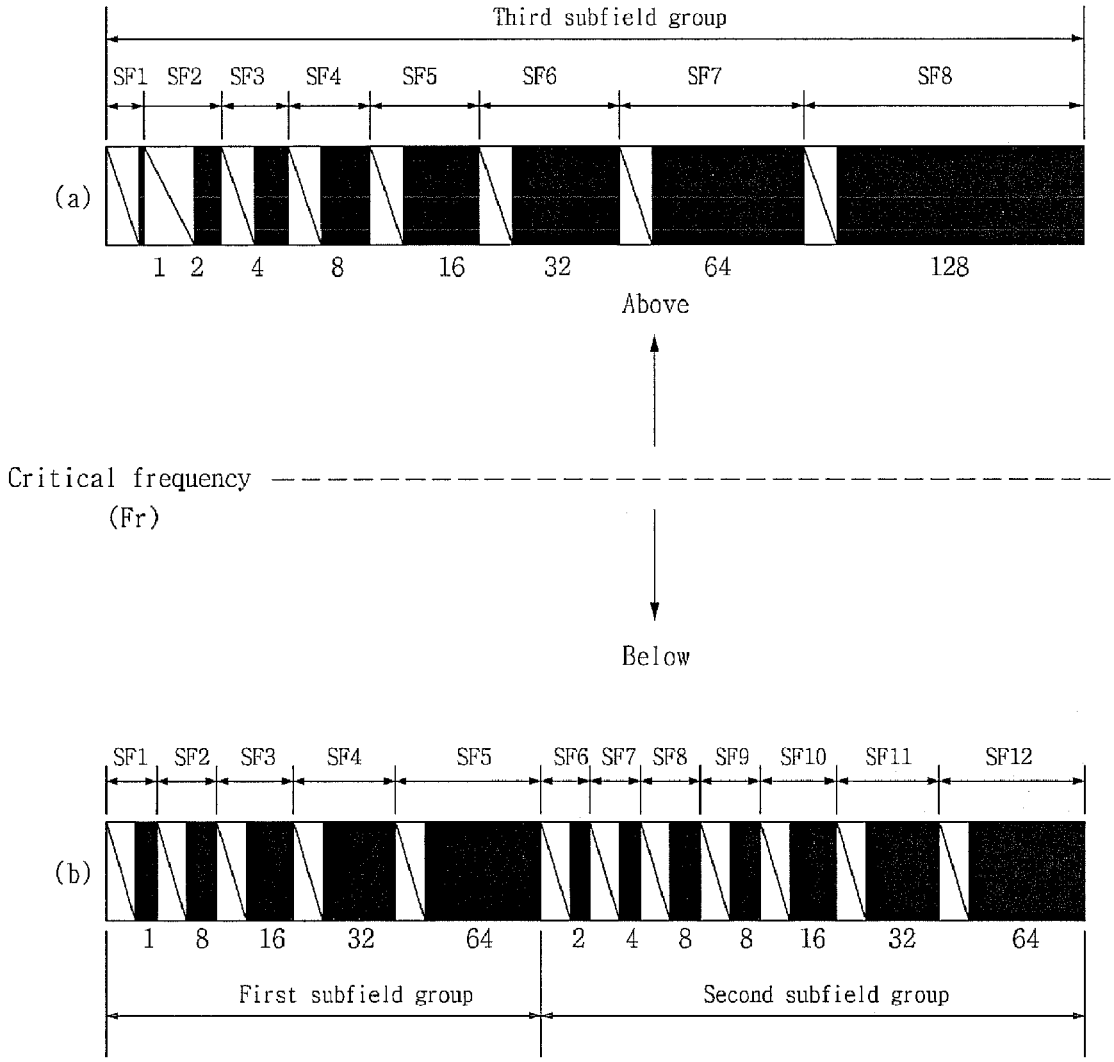
FIG. 4 illustrates an example of an operation of a driver of a plasma display apparatus according to the present invention.

FIG. 4 illustrates an example of an operation of a driver of a plasma display apparatus according to the present invention.

Referring to FIG. 4, a frame is comprised of a first subfield group and a second subfield group when a vertical frequency of an image signal inputted is less than a critical frequency (Fr) of about 50 Hz to 70 Hz. The first subfield group and the second subfield group each comprise one or more subfields. Alternatively, a frame is comprised of a third subfield group comprising one subfield when a vertical frequency of an image signal is greater than the critical frequency (Fr).

For example, as shown in FIG. 4A, one frame can be comprised of a single third subfield group when a vertical frequency of an image signal inputted is greater than the critical frequency (Fr). The third subfield group is comprised of a total of eight subfields ranging from a first subfield (SF1) to an eighth subfield (SF8).

Numeral denoted every subfield represents a gray level weight of each subfield.

Alternatively, as shown in FIG. 4B, one frame can be comprised of a first subfield group and a second subfield group when a vertical frequency of an image signal inputted is less than the critical frequency (Fr). The first subfield group is comprised of a total of five subfields ranging from a first subfield (SF1) to a fifth subfield (SF5). The second subfield group is comprised of a total of seven subfields ranging from a sixth subfield (SF6) to a twelfth subfield (SF12). The number of subfields belonging to the first subfield group can be equal or different from the number of subfields belonging to the second subfield group. For example, the number of the subfields of the first subfield group can be less than the number of the subfields of the second subfield group.

Further, the number of subfields of the third subfield group can be equal or less than a sum of the number of subfields of the first subfield group and the number of subfields of the first subfield group.

The subfields are arranged in each of the subfield groups, that is, the first subfield group and the second subfield group in an ascending order of dimensions of gray level weights, that is, dimensions of gray level values. In detail, a subfield having the lowest dimension of a gray level weight, that is, a gray level value is positioned in an initial stage of each subfield group and a subfield having a higher gray level weight is positioned as going to a latter stage.

A sum of gray level weights of the arranged subfields is equal to 1+2+4+8+(8+8)+(16+16)+(32+32)+(64+64), that is, 255 within one frame. As a result, 256 gray levels can be realized as in a frame of FIG. 4A in which subfields having gray level weights of 1, 2, 4, 8, 16, 32, 64, and 128 are arranged in sequence.

When a vertical frequency of an image signal inputted is relatively low, occurrence of flicker can be reduced if a frame is divided into two subfield groups.

In detail, when the vertical frequency is less than the critical frequency (Fr), the occurrence of flicker gets worse if a frame is comprised of one subfield group.

Alternatively, when one frame comprises a first subfield group realizing 121 gray levels and a second subfield group realizing 135 gray levels as shown in FIG. 4B, an effect of realizing two frames realizing 121 and 135 gray levels by one frame realizing 256 gray levels can be obtained. This results in an effect of visually doubly increasing a frame frequency and thus, the occurrence of flicker reduces on a screen.

It is desirable that the number of sustain signals per gray level is controlled depending on a vertical frequency of an image signal inputted.

Figure 5A:
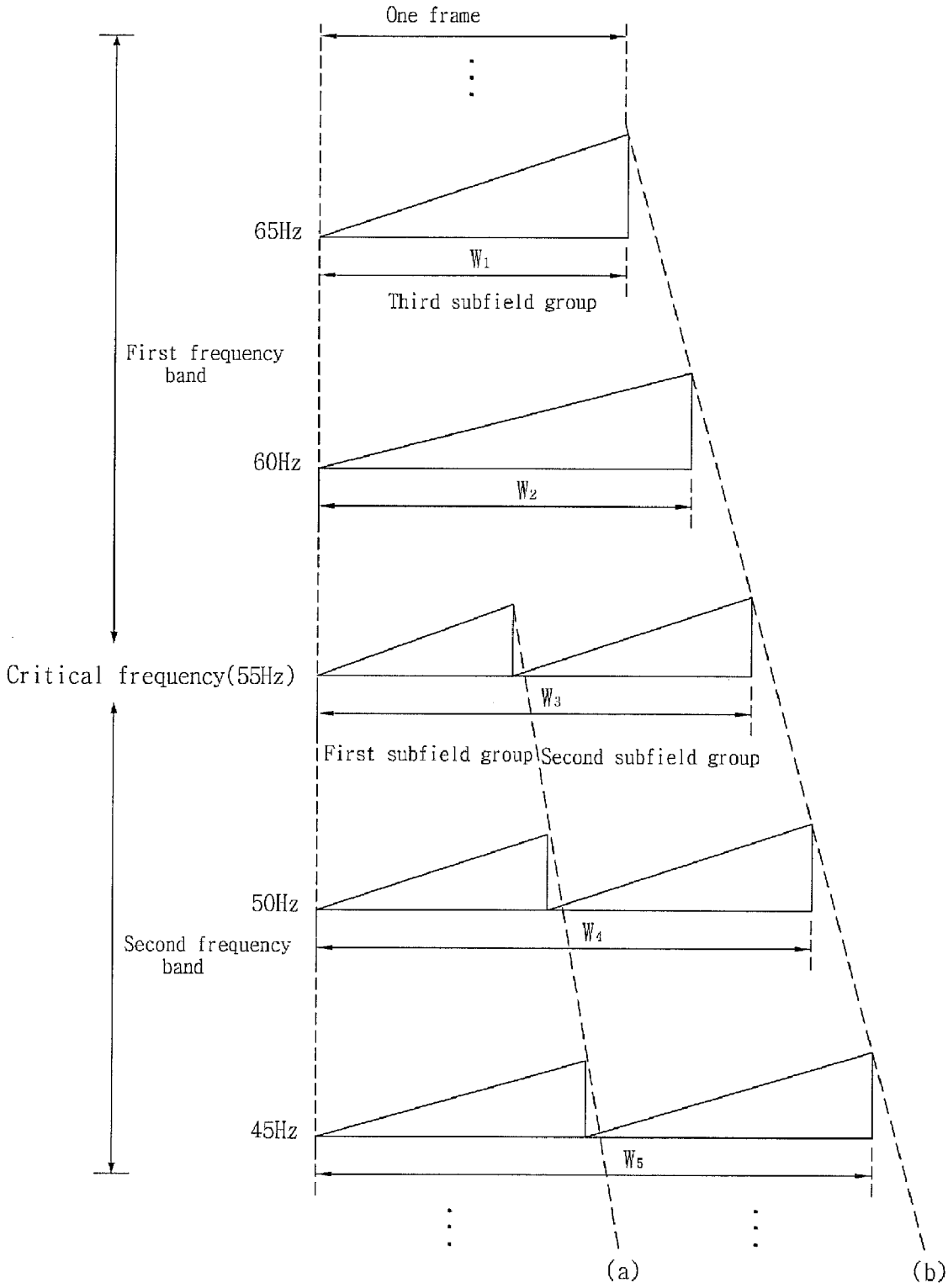
FIGS. 5A to 5C illustrate an example of a method for controlling the number of sustain signals per gray level depending on a vertical frequency of an image signal inputted.
Figure 5B:
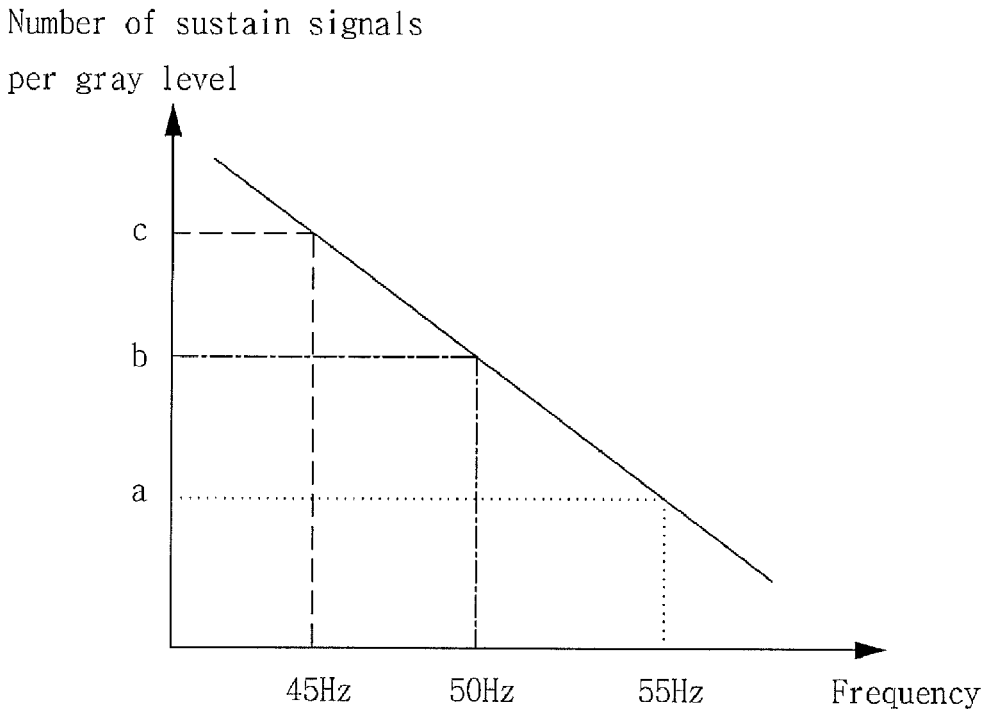
Figure 5C:
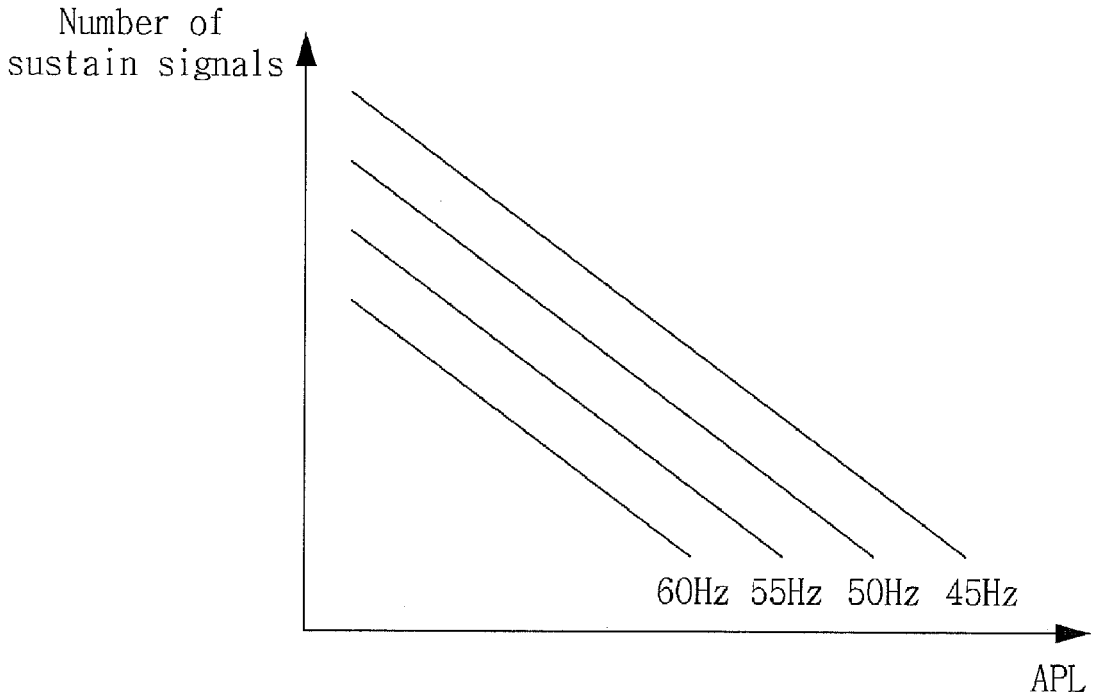

FIGS. 5A to 5C illustrate an example of a method for controlling the number of sustain signals per gray level depending on a vertical frequency of an image signal inputted.

In FIG. 5A, each subfield group is expressed in a triangle shape to facilitate understanding. This means that subfields are arranged in an ascending order of dimensions of gray level weights within each subfield group.

Referring to FIG. 5A, when a vertical frequency of an image signal inputted is less than 55 Hz, for example, is equal to 55 Hz, 50 Hz, or 45 Hz, one frame is divided into a first subfield group and a second subfield group. Alternatively, when the vertical frequency is greater than 55 Hz, for example, is equal to 60 Hz or 65 Hz, one frame is comprised of a single third subfield group. In a different expression, one frame is divided into a first frequency band and a second frequency band on the basis of a specific vertical frequency of an image signal inputted. The first frequency band and the second frequency band each comprise at least two frequencies at which an image is displayed by a frame having a different length. The specific vertical frequency is substantially equal to the critical frequency.

The first frequency band is a frequency band higher than the specific vertical frequency. The second frequency band is a frequency band lower than the specific vertical frequency. They can be also expressed vice versa.

Thus, the second frequency band is comprised of two subfield groups comprising a plurality of subfields in one frame.

In this case, a critical frequency is set to 55 Hz. The reason why the critical frequency is set to 55 Hz is that the occurrence of flicker can more increase when the vertical frequency is less than 55 Hz.

It is assumed that a first frequency is equal to 50 Hz, a second frequency is equal to 45 Hz, a third frequency is equal to 60 Hz, and a fourth frequency is equal to 65 Hz.

It is desirable that the number of sustain signals per gray level at the second frequency is greater than that of the first frequency when a vertical frequency of an image signal inputted comprises the first frequency lower than the critical frequency and the second frequency lower than the first frequency.

Further, it is desirable that the number of sustain signals per gray level at the third frequency is greater than that of the fourth frequency when the vertical frequency comprises the third frequency higher than the critical frequency and the fourth frequency higher than the third frequency.

For example, as shown in FIG. 5B, the number of sustain signals per gray level is equal to "b" greater than "a" when the vertical frequency is equal to 50 Hz, assuming that the number of sustain signals per gray level is equal to the "a" when the vertical frequency is equal to 55 Hz. Further, the number of sustain signals per gray level is equal to "c" greater than the "a" and the "b" when the vertical frequency is equal to 45 Hz.

As described above, a starting point at which a second subfield group is applied can be different depending on the vertical frequency of the image signal inputted.

In detail, as shown in FIG. 5A, when the vertical frequency is relatively lower than the critical frequency, a starting point (a) of the second subfield group of the frame can be delayed more and more if the number of sustain signals per gray level increases.

Further, when the vertical frequency is relatively lower than the critical frequency, a length of one frame can increase if the number of sustain signals per gray level increases.

For example, a length (W4) of one frame is equal to about 20 ms when the vertical frequency is equal to 50 Hz. A length (W2) of one frame is equal to about 16.67 ms when the vertical frequency is equal to 60 Hz. The frame length (W4) at the vertical frequency of 50 Hz is greater than the frame length (W2) at the vertical frequency of 60 Hz.

Desirably, a relationship of W1<W2<W3<W4<W5 is given.

In this way, a structure of a frame is changed depending on a vertical frequency of an image signal, and the number of sustain signals per gray level is controlled, thereby implementing a stable operation at each frequency.

The inventive plasma display apparatus can be applied when an image signal having a frequency of 45 Hz, 50 Hz, 55 Hz, 60 Hz, or 65 Hz is used. For example, the inventive plasma display apparatus can be applied to various fields such as television (TV) sets, computer monitors, and games. In detail, there is a diversity of application. As shown in FIG. 5C, the number of sustain signals can increase or decrease depending on a frequency at the same Average Picture Level (APL). In detail, the number of sustain signals increases as the frequency decreases at the same APL.

A first frequency region is equal to 60 Hz or 65 Hz greater than 55 Hz and a second frequency region is equal to 50 Hz or 45 Hz, when a specific vertical frequency of an image signal is set to 55 Hz. Here, the number of sustain signals can linearly increase or decrease depending on APL at a plurality of frequencies belonging to the first frequency band and the second frequency band.

This is because a stable operation can be performed at each frequency by controlling the number of sustain signals depending on APL.

The above is a description of only a case that subfields are arranged in one frame in an ascending order of dimensions of gray level weights. Unlike this, subfields can be arranged in one frame in a descending order of gray level weights. Alternately, the subfields can be arranged irrespective of the gray level weight.

Figure 6A:
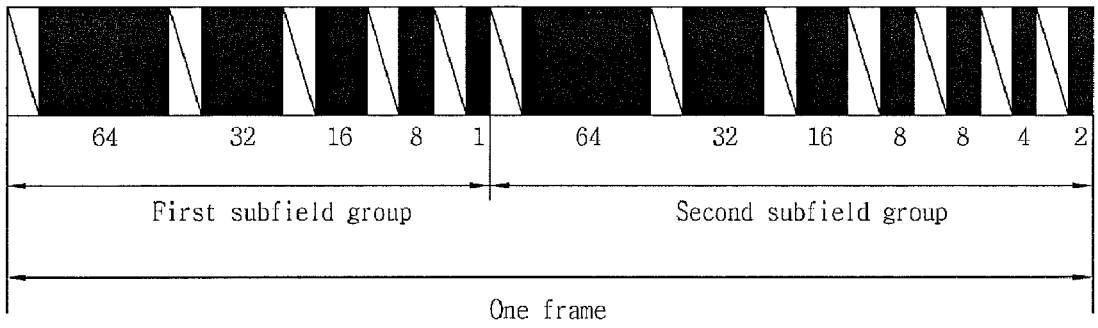
FIGS. 6A and 6B illustrate an arrangement of subfields within one frame.
Figure 6B:
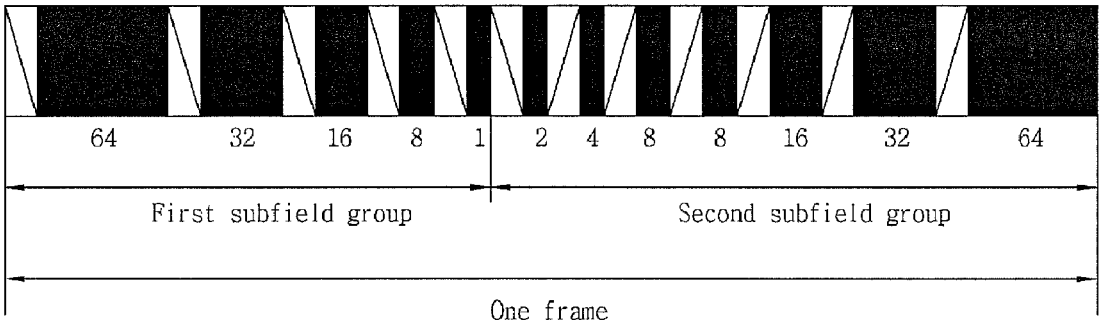

FIGS. 6A and 6B illustrate an arrangement of subfields in one frame.

Referring to FIGS. 6A and 6B, the subfields can be arranged in at least one of two subfield groups of the frame in an ascending order of gray level weights.

The subfields can be arranged in at least one of two subfield groups of the frame in a descending order of gray level weights.

For example, the subfields can be arranged in a first subfield group in a descending order of the gray level weights, and the subfields can be arranged in a second subfield group in an ascending order of the gray level weights.

Figure 7:
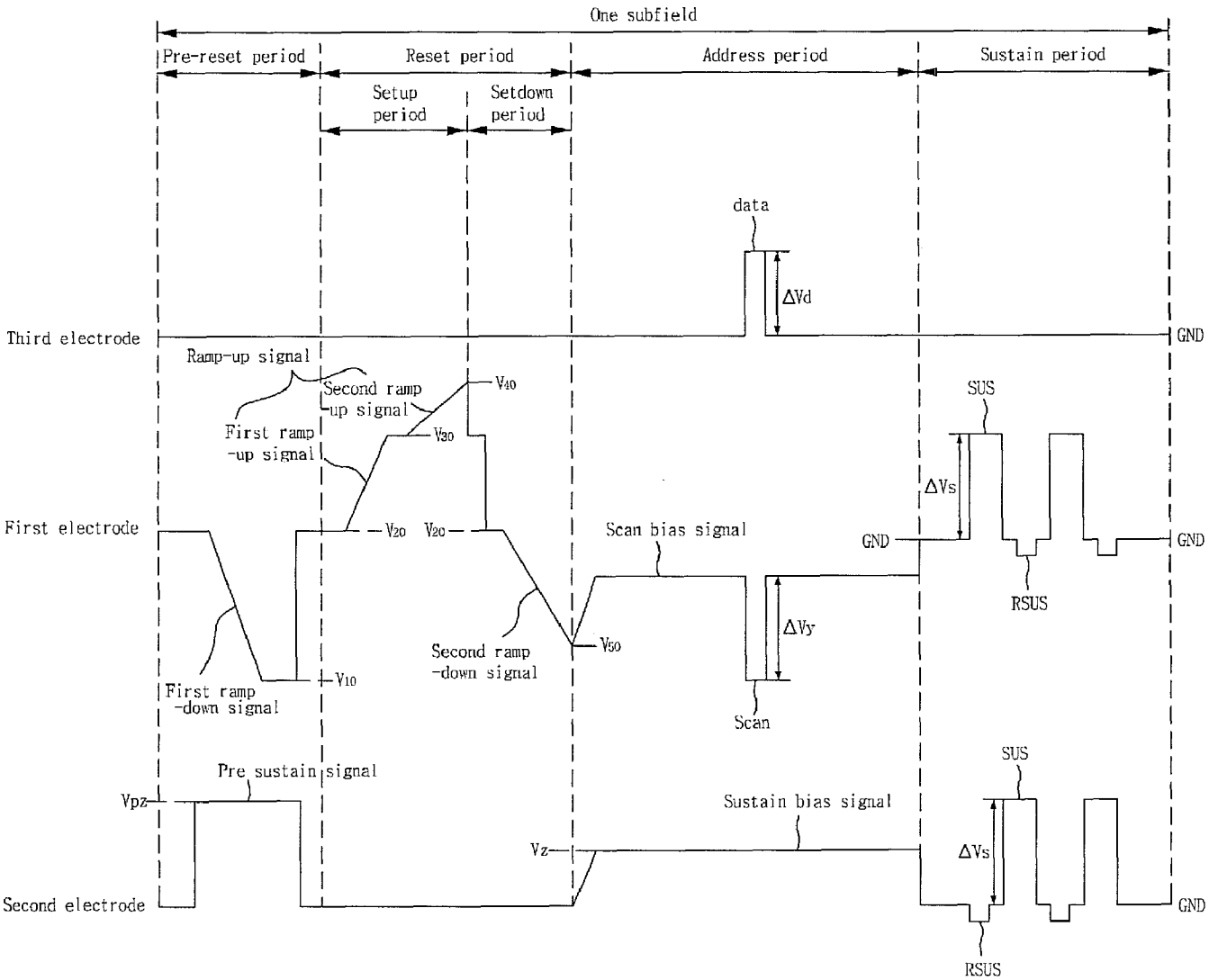
FIG. 7 illustrates an example in which a driver of a plasma display apparatus operates in any one of a plurality of subfields comprised in a frame.

FIG. 7 illustrates an example in which the driver of the plasma display apparatus operates in any one of a plurality of subfields comprised in a frame.

Referring to FIG. 7, the driver 110 of FIG. 10 can supply a first ramp-down signal to a scan electrode in a pre reset period prior to a reset period.

Further, the driver 110 can supply a pre sustain signal having an opposite polarity to the first ramp-down signal to a sustain electrode while supplying the first ramp-down signal to the scan electrode.

It is desirable that the first ramp-down signal applied to the scan electrode ramps down to a tenth voltage (V10). It is desirable that the first ramp-down signal ramps down from a voltage of a ground level (GND).

It is desirable that the pre sustain signal substantially constantly sustains a pre sustain voltage (Vpz). It is desirable that the pre sustain voltage (Vpz) is approximately equal to a voltage of a sustain signal (SUS) applied in a sustain period, that is, to a sustain voltage (Vs).

As above, the first ramp-down signal is applied to the scan electrode and the pre sustain signal is supplied to the sustain electrode in a pre reset period. By doing so, wall charges having a predetermined polarity are accumulated on the scan electrode, and wall charges having an opposite polarity to the scan electrode are accumulated on the sustain electrode. For example, positive (+) wall charges are accumulated on the scan electrode, and negative wall charges are accumulated on the sustain electrode.

Accordingly, a set-up discharge can be induced at a sufficient intensity in a reset period. As a result, initialization can be performed stably enough.

Before the reset period, the pre reset period can be provided in one subfield having the smallest gray level weight among subfields of a frame. Alternately, before the reset period, the pre reset period can be also provided in two or three subfields among the subfields of the frame.

Alternately, the pre reset period can be also omitted in all subfields.

After the pre reset period, the driver 110 can apply a ramp-up signal having the direction of an opposite polarity to the first ramp-down signal to the scan electrode in a set-up period of the reset period for initialization.

The ramp-up signal can comprise a first ramp-up signal that ramps down at a first slope from a twentieth voltage (V20) to a thirtieth voltage (V30) and a second ramp-up signal that ramps up at a second slope from the thirtieth voltage (V30) to a fortieth voltage (V40).

In the set-up period, the ramp-up signal induces a weak dark discharge, that is, a set-up discharge within a discharge cell. By the set-up discharge, wall charges are accumulated to some degree within the discharge cell.

It is desirable that the second slope of the second ramp-up signal is gentler than the first slope. At the second slope gentler than the first slope, a voltage increases relatively abruptly until before the set-up discharge and a voltage increases relatively gently during the set-up discharge, thereby reducing an amount of light generated by the set-up discharge.

Accordingly, a contrast characteristic can be improved.

Subsequently to the ramp-up signal, the driver 110 can apply a second ramp-down signal of the direction of an opposite polarity to the ramp-up signal to the scan electrode in a set-down period after the set-up period.

It is desirable that the second ramp-down signal ramps down from the twentieth voltage (V20) to a fiftieth voltage (V50).

Thus, a weak erase discharge, that is, a set-down discharge is induced within the discharge cell. Wall charges uniformly remain enough to stably induce an address discharge by the set-down discharge.

Figure 8:
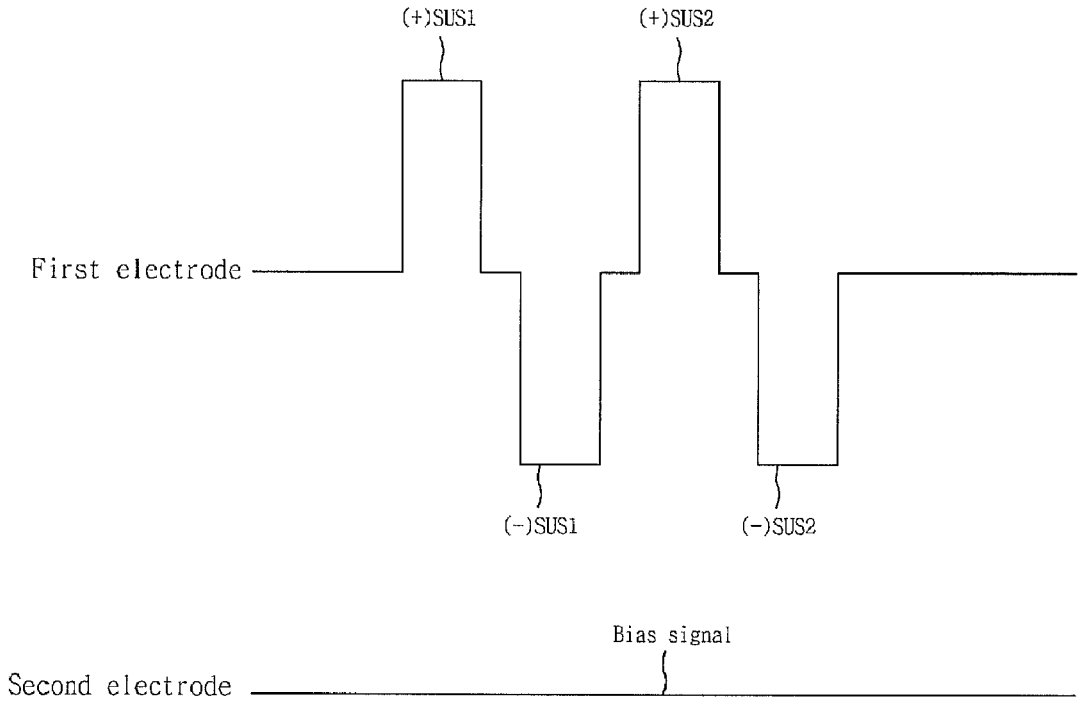
FIG. 8 illustrates another type of a sustain signal.

FIG. 8 illustrates another type of a sustain signal.

Referring to FIG. 8, a positive sustain signal and a negative sustain signal are alternately applied to any one of the scan electrode and the sustain electrode, for example, to the scan electrode. For example, a first positive sustain signal (+SUS1) is applied to the scan electrode. After that, a first negative sustain signal (−SUS1) is again applied to the scan electrode. After that, a second positive sustain signal (+SUS2) is again applied to the scan electrode. After that, a second negative sustain signal (−SUS2) is applied to the scan electrode.

The driver can be more simplified in shape when the sustain signal is applied to only one of the scan electrode and the sustain electrode in a sustain period and a bias signal is applied to the other as described above.

Figure 9A:
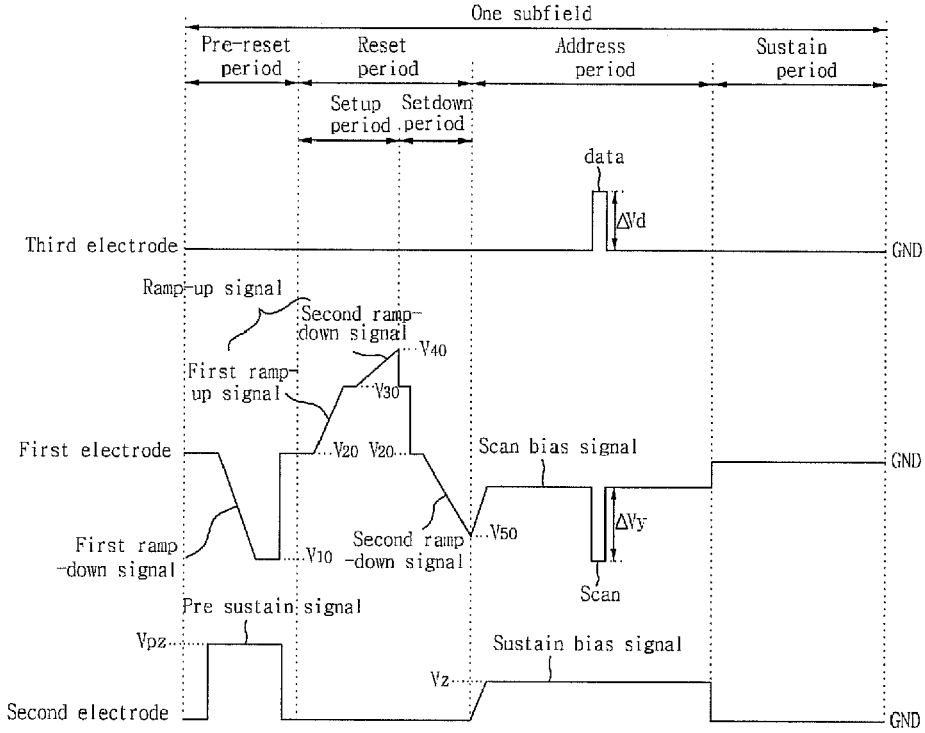
FIGS. 9A to 9C illustrate an implementation of an example of an operation of a supply to a first subfield group comprised in a frame.
Figure 9A:
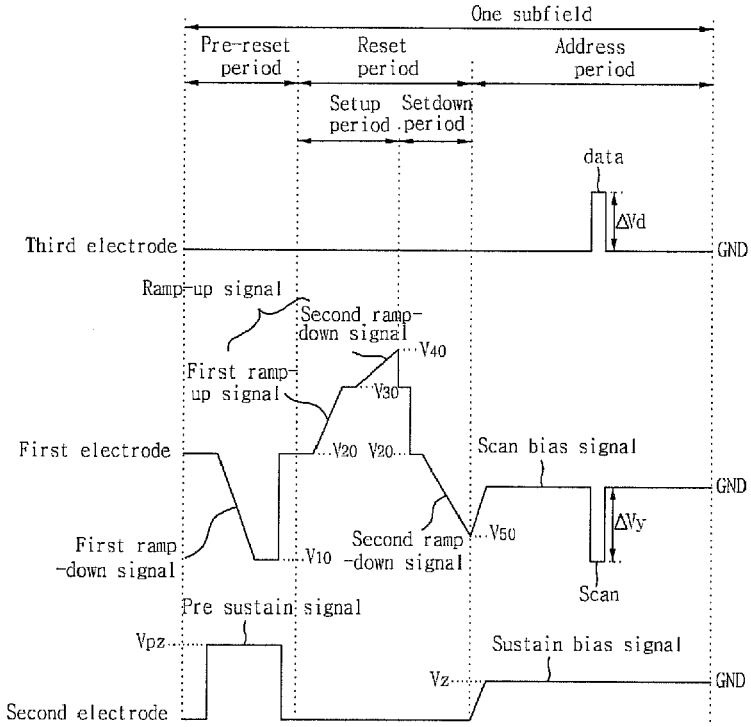
Figure 9B:
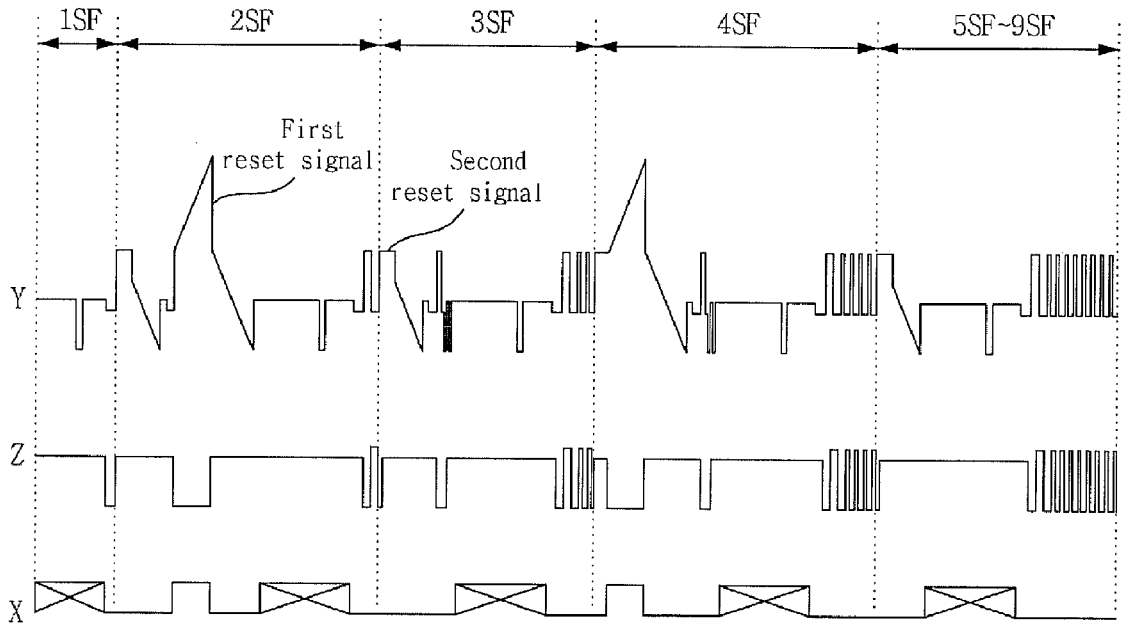
Figure 9C:
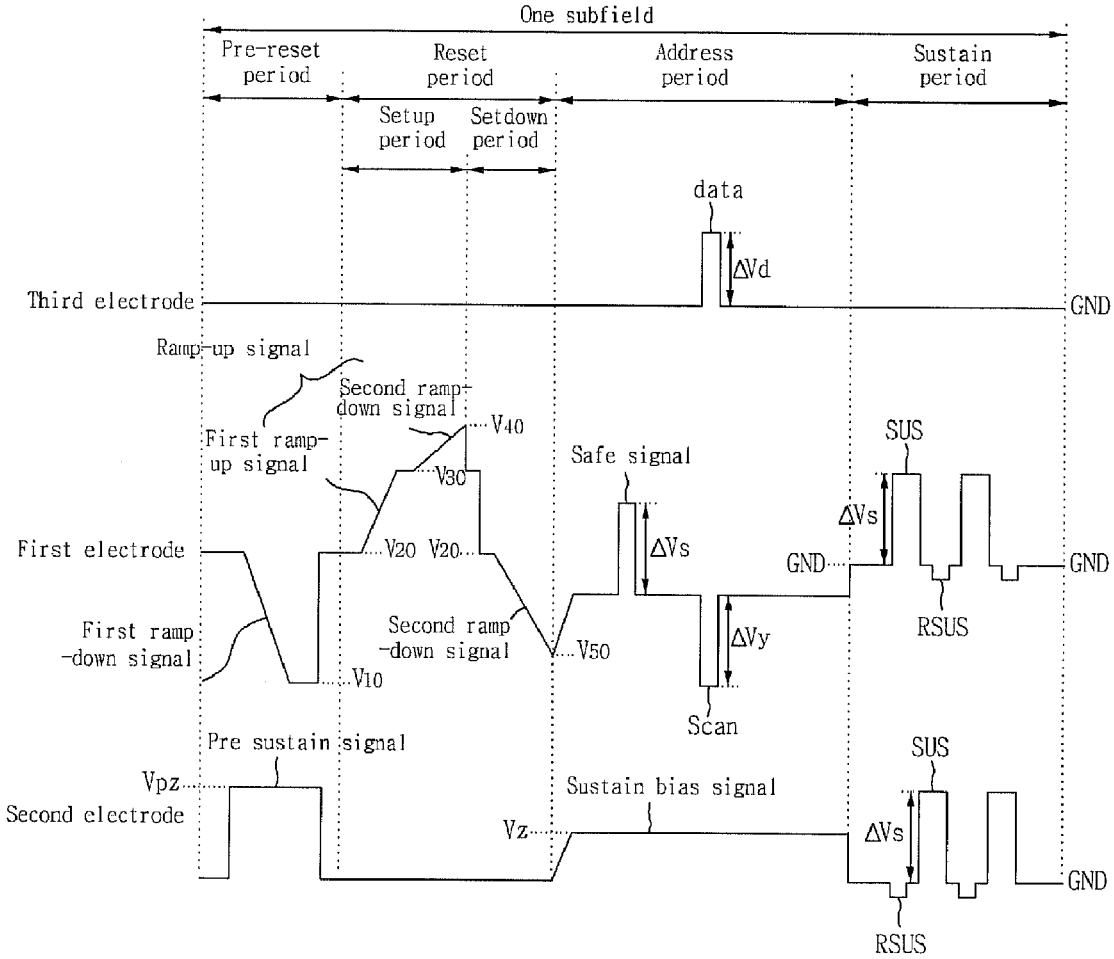

FIGS. 9A to 9C illustrate an implementation of an example of an operation of a supply to a first subfield group comprised in a frame.

In FIGS. 9A to 9C, the same as the above description will be omitted.

Referring to FIG. 9A, the driver does not supply a sustain signal to a scan electrode (Y) and a sustain electrode (Z), or a sustain period for supplying a sustain signal is omitted. Hence, a gray level having a decimal value less than 1 can be achieved. This leads to an increase in gray scale representation of an image, specifically, the representation at a low gray level. Thus, a subfield of a decimal gray level desirably is the first subfield having the lowest gray level weight among a first subfield group.

For example, a sustain period is comprised in one subfield as shown in FIG. 9A. In the sustain period, a sustain signal is neither supplied to the scan electrode (Y) nor to the sustain electrode (Z). Thus, a discharge having influence upon gray level expression is an address discharge induced in an address period. In detail, before a sustain period of a subfield of a decimal gray level, a scan signal having a negative voltage is supplied to the scan electrode, and a constant positive voltage is substantially supplied to the sustain electrode. Thus, an address discharge has main influence upon gray level expression. Unlike FIG. 9A, FIG. 9B shows an example of a case where a sustain period for supplying a sustain signal is omitted. In detail, the sustain period for supplying the sustain signal is omitted and thus, a decimal gray level of less than 1 is realized. A discharge having influence upon gray level expression substantially is the same as that of FIG. 9A. Referring to FIG. 9B, as described in FIG. 9A, a sustain signal is not applied in the first subfield to express a decimal gray level. In other words, the decimal gray level is expressed using a discharge induced by a negative scan signal applied to the scan electrode in the address period. The expression of the decimal gray level is to set a center axis of light by frames.

The driver can supply a first reset signal to a scan electrode in a reset period of a partial subfield among a first subfield group and supply a second reset signal having a smaller voltage than the first reset signal in a reset period of a remaining subfield in which the first reset signal is not supplied.

The reason why the first reset signal is selected and supplied in the reset period as above is that supplying all reset signals in all subfields leads to a short of a driving time and also a deterioration of a contrast characteristic caused by reset signal light.

The driver can supply a data voltage to an address electrode while supplying a first reset signal to a scan electrode. This is to prevent a strong reset discharge by supplying a data voltage to the address electrode and reducing a voltage difference between the scan electrode and the address electrode.

Referring to FIG. 9C, the driver supplies a safe signal having an opposite polarity to a scan signal in the partial subfield of the first subfield group in a period after a first reset signal or a second reset signal is supplied to the scan electrode before a scan signal having a negative voltage is supplied.

The safe signal can have substantially the same voltage magnitude as a magnitude of a sustain voltage. Also, the safe signal can comprise not only a square signal but also a ramp-up signal.

A reliability of driving can be more guaranteed by supplying a safe signal to a scan electrode in a period after a first reset signal or a second reset signal is supplied before a scan signal having a negative voltage is supplied.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel for displaying an image by a frame comprising a plurality of subfields; and a driver for, when a vertical frequency of an image signal inputted is less than a critical frequency, dividing the frame into a first subfield group and a second subfield group each comprising one or more subfields, the number of subfields of the first subfield group being different from the number of subfields of the second subfield group, and when the vertical frequency is more than the critical frequency, constituting the frame by a third subfield group comprising one or more subfields.

2. The apparatus of claim 1, wherein the number of sub fields of the first subfield group is less than the number of subfields of the second subfield group.

3. The apparatus of claim 1, wherein the number of subfields of the third subfield group is less than a sum of the number of subfields of the first subfield group and the number of subfields of the second subfield group.

4. The apparatus of claim 1, wherein the vertical frequency of the image signal comprises a first frequency lower than the critical frequency and a second frequency lower than the first frequency, and wherein the driver increases the number of sustain signals per gray level at the second frequency more than that of the first frequency.

5. The apparatus of claim 1, wherein the vertical frequency of the image signal comprises a third frequency higher than the critical frequency and a fourth frequency higher than the third frequency, and wherein the driver increases the number of sustain signals per gray level at the third frequency more than that of the fourth frequency.

6. The apparatus of claim 1, wherein the critical frequency is substantially more than 50 Hz and less than 60 Hz.

7. The apparatus of claim 1, wherein the subfields are arranged in a descending order of gray level weights in any one of the first subfield group and the second subfield group.

8. A method for driving a plasma display apparatus displaying an image during a frame comprising a plurality of subfields, wherein the driving is performed at a first frequency band and a second frequency band divided on the basis of a specific vertical frequency of an image signal inputted, and wherein the driving is performed at the first frequency band and the second frequency band each comprising at least two frequencies at which an image is displayed by a frame having a different length.

9. The method of claim 8, wherein there is a frequency difference of any integer multiple of 5 between at least two frequencies included in each of the first frequency band and the second frequency band based on the specific vertical frequency.

10. The method of claim 8, wherein one frame is comprised of two subfield groups comprising a plurality of subfields in one of the first frequency band and the second frequency band.

11. The method of claim 10, wherein a sustain period does not exist or a sustain signal is not applied in a first subfield belonging to a first subfield group of the two subfield groups.

12. The method of claim 8, wherein the number of sustain signals of the first frequency band or the second frequency band increases at a same average picture level (APL) as the frequency gets lower than the specific vertical frequency.

13. The method of claim 8, wherein the number of sustain signals linearly increases or decreases depending on average picture level (APL) at a plurality of frequencies belonging to the first frequency band and the second frequency band.

14. The method of claim 10, wherein the number of subfields comprised in each of the two subfield groups is different.

15. The method of claim 10, wherein the subfields are arranged in an ascending or descending order of gray level weights in at least any one of the two subfield groups.

* * * * *